US005329838A

United States Patent [19]

Yamashita

[11] Patent Number: 5,329,838

[45] Date of Patent: Jul. 19, 1994

[54] DRUM WITH SHELL LESS SUSCEPTIBLE TO INFLUENCE FROM DRUM STAND

[75] Inventor: Toshinori Yamashita, Shizuoka, Japan

[73] Assignee: Yamaha Corporation, Hamamatsu, Japan

[21] Appl. No.: 8,177

[22] Filed: Jan. 25, 1993

Related U.S. Application Data

[63] Continuation-in-part of Ser. No. 819,814, Jan. 12, 1992, abandoned.

[30] Foreign Application Priority Data

Jan. 14, 1991 [JP] Japan ..... 3-14807
Oct. 25, 1991 [JP] Japan ..... 3-306689

[51] Int. Cl.[5] ..... G10D 13/02
[52] U.S. Cl. ..... 84/421; 84/411 R
[58] Field of Search ..... 84/421, 411; 248/638

[56] References Cited

U.S. PATENT DOCUMENTS 3,541,914 11/1970 Thompson ..... 84/421
4,126,075 11/1978 Kurosaki ..... 84/421
4,158,980 6/1979 Gauger ..... 84/421
4,252,047 2/1981 Gauger ..... 84/421
4,448,105 5/1984 Cordes ..... 84/413
4,640,175 2/1987 Hoshino ..... 84/421
4,660,455 4/1987 Jones et al. ..... 84/213
4,700,437 10/1987 Hoshino ..... 24/456
4,779,509 10/1988 Weir ..... 84/421
5,046,700 9/1991 Hoshino ..... 248/638
5,076,132 12/1991 Hsieh ..... 84/421

*Primary Examiner*—Michael L. Gellner
*Assistant Examiner*—Cassandra Spyrou
*Attorney, Agent, or Firm*—Spensley Horn Jubas & Lubitz

[57] ABSTRACT

A drum comprises a shell defining a hollow space extending along a predetermined direction, a head stretched over the hollow space, and a supporting mechanism provided between the shell and a drum stand. The drum stand is affixed to the shell at a predetermined position. Vibrations take place in the shell upon beating the head. The predetermined position is matched with an area where the vibrations minimize the amplitude thereof so that the beats are less susceptible to influence from the supporting mechanism.

10 Claims, 9 Drawing Sheets

DRUM WITH SHELL LESS SUSCEPTIBLE TO INFLUENCE FROM DRUM STAND

RELATED APPLICATIONS

This application is a continuation-in-part of U.S. patent application Ser. No. 07/819,814 filed Jan. 13, 1992, now abandoned.

FIELD OF THE INVENTION

This invention relates to a drum and, more particularly, to a shell supported by a drum holder at an appropriate position in view of vibrations.

DESCRIPTION OF THE RELATED ART various drums have been proposed, and a prior art drum is disclosed in U.S. Pat. No. 4,448,105. In the drum disclosed in U.S. Pat. No. 4,448,105, a head is affixed to a shell with a hoop, and the hoop is coupled with a rim at the opposite end by means of a plurality of connecting tubes. A drum stand is held in contact with the connecting tubes, and accordingly, only the hoop and the rim are directly held in contact with the shell.

Another drum is disclosed in U.S. Pat. No. 4,252,047, and the shell is supported by a post or a drum stand through a semi-circular member attached to a lower rim thereof. Therefore, only the semi-circular member is directly attached to the shell.

Yet another drum is disclosed in U.S. Pat. No. 4,158,980. A supporting bracket disclosed therein comprises a circular bracket held in contact with the rim of a shell. There are also plates projecting from the circular bracket, and a drum stand or legs are coupled with the plates by means of connecting members.

All of the prior art supporting mechanisms for the drums described hereinbefore are not of the type directly supporting a drum shell. The drum stands are held in contact with the rims or the hoops, and accordingly, the drums are supported by the drum stand through the rims or the hoops. These supporting mechanisms provide only a fair improvement to the beats.

Still another prior art drum directly supported by a drum stand is disclosed in Japanese Utility Model Application laid-open (Kokai) No. 64-55985. Here, clampets are directly screwed to the shell of the drum. However, between the shell and the clampets there are damping members which are expected to improve the beats.

However, a problem is encountered in all the prior art drum supporting mechanisms disclosed in the U.S. patents described above. This involves complexity of the structure as well as a lack of flexibility. The complexity is inherent from the indirect supporting mechanisms used. The poor flexibility is due to the semicircular member, the connecting tubes and so forth which are tailored for each individual drum. Therefore, if a different sized drum is required, the manufacturer needs to redesign and tailor the members for each new drum.

Even though damping members may be inserted between the shell of the drum and the clampers, as disclosed in the Japanese Utility Model Application laid-open, the beats are still susceptible to interference, and the drum can not produce excellent quality beats.

SUMMARY OF THE INVENTION

It is therefore an important object of the present invention to provide a drum which is simple and flexible without sacrificing the quality of beats.

To accomplish these objects, the present invention proposes to affix a supporting means to a shell at a predetermined position where vibrations are minimized in amplitude thereof.

In accordance with the present invention, there is provided a drum comprising: a) a shell defining a hollow space extending along a predetermined direction; b) a head stretched over the hollow space and affixed to the shell by a fastening means, with vibrations of the head causing resonant vibrations to take place in the shell when the head is beaten, the head transferring the force of a beat to the shell so as to produce forced vibrations in the shell, the resonant vibrations having nodal lines shared with the forced vibrations, and the fastening means being affixed to the shell at a first predetermined location on one of the nodal lines; and c) a supporting mechanism provided between the shell and a drum stand means, and affixed to the shell at a second predetermined location on one of the nodal lines.

Other features and advantages of the invention will become apparent from the following detailed description, taken in conjunction with the accompanying drawings which illustrate, by way of example, various features of embodiments of the invention.

BRIEF DESCRIPTION OF THE DRAWINGS

The features and advantages of the drum according to the present invention will be more clearly understood from the following description taken in conjunction with the accompanying drawings in which.

DESCRIPTION OF THE PREFERRED EMBODIMENTS

Figure 1:
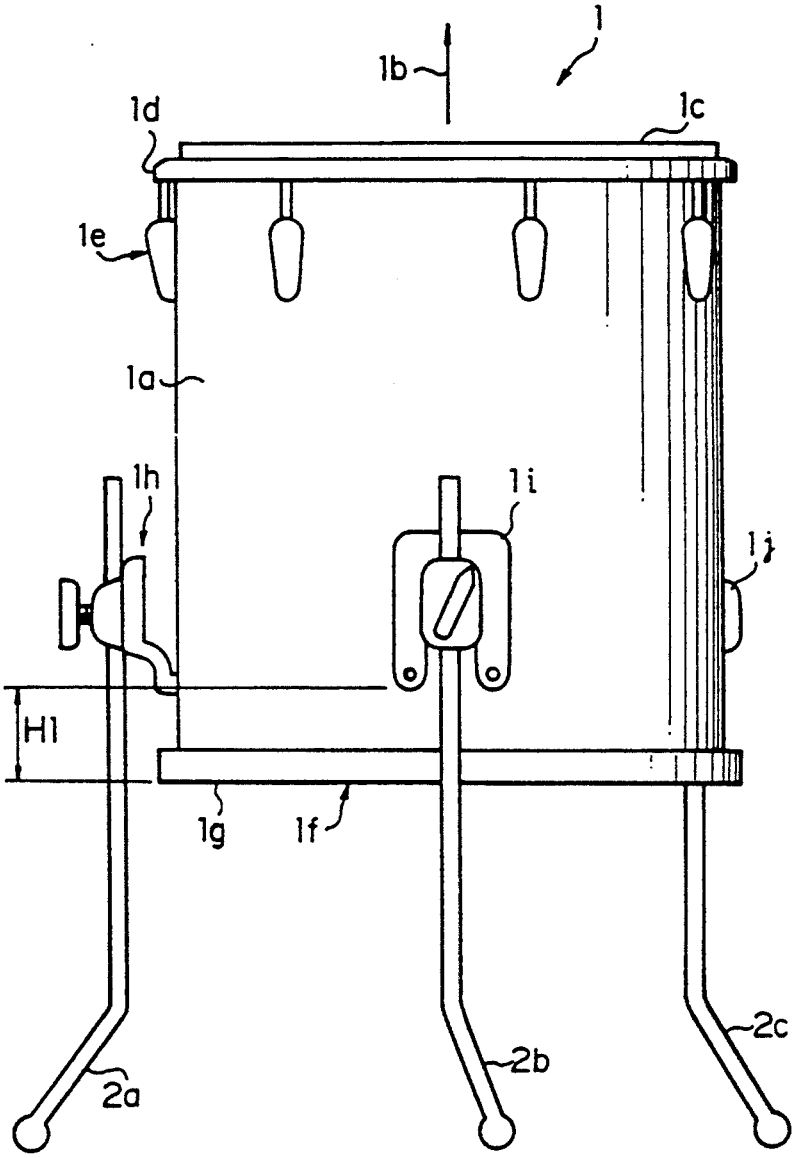
FIG. 1 is a front view showing a floor-tom according to the present invention.

As shown in the drawings for purposes of illustration, the invention is embodied in a drum holding device affixed to the shell surface of a drum. In preferred embodiments of the present invention, the drum holding device is attached at a node line where the vibrations in the shell are at a minimum. In further embodiments of the present invnetion, the drum holding device may be attached to the shell in a cantilever fashion to further isolate the drum from the damping effects of an attached drum stand.

First Embodiment

Referring first to FIG. 1 of the drawings, a floor-tom embodying the present invention 1 is supported by a plurality of legs 2a, 2b and 2c serving as a drum stand means. The floor-tom 1 also comprises a shell la shaped into a cylindrical configuration. Therefore, the shell 1a defines a hollow space extending along a longitudinal direction 1b thereof; and in this instance, the longitudinal direction means a predetermined direction. A head 1c is stretched over one of the openings of the hollow space of the shell 1a, and is affixed to the shell by means of a hoop 1d which is assisted by a fastening mechanism 1e. A rim 1f is affixed to the opposite end of the shell 1a, and an edge 1g of the rim 1f provides a standard line as described hereinbelow.

The legs 2a–2c are fastened to the shell 1a by means of supporting units 1h, 1i and 1j which form, in combination, a supporting mechanism. The supporting units 1h–1j are affixed to the shell 1a in such a manner that vibrations produced by beating with a drum stick minimize the vibration amplitude at the areas where the legs are held in contact, and each of the supporting units 1h, 1i and 1j is held in contact only with the shell in this area only. This means that the supporting units 1h–1j are supported by the shell 1a in a cantilever fashion, while the other ends are spaced apart from the surface of the shell 1a. Since the vibrations of the floor-tom 1 repeat node and antinode along the longitudinal direction, the supporting units 1h–1j are affixed to the shell 1a at areas spaced apart from the standard edge 1g by a distance H1. The distance H1 is determined by the geometries of the hollow space, i.e., the diameter and the depth.

Second Embodiment

Figure 2:
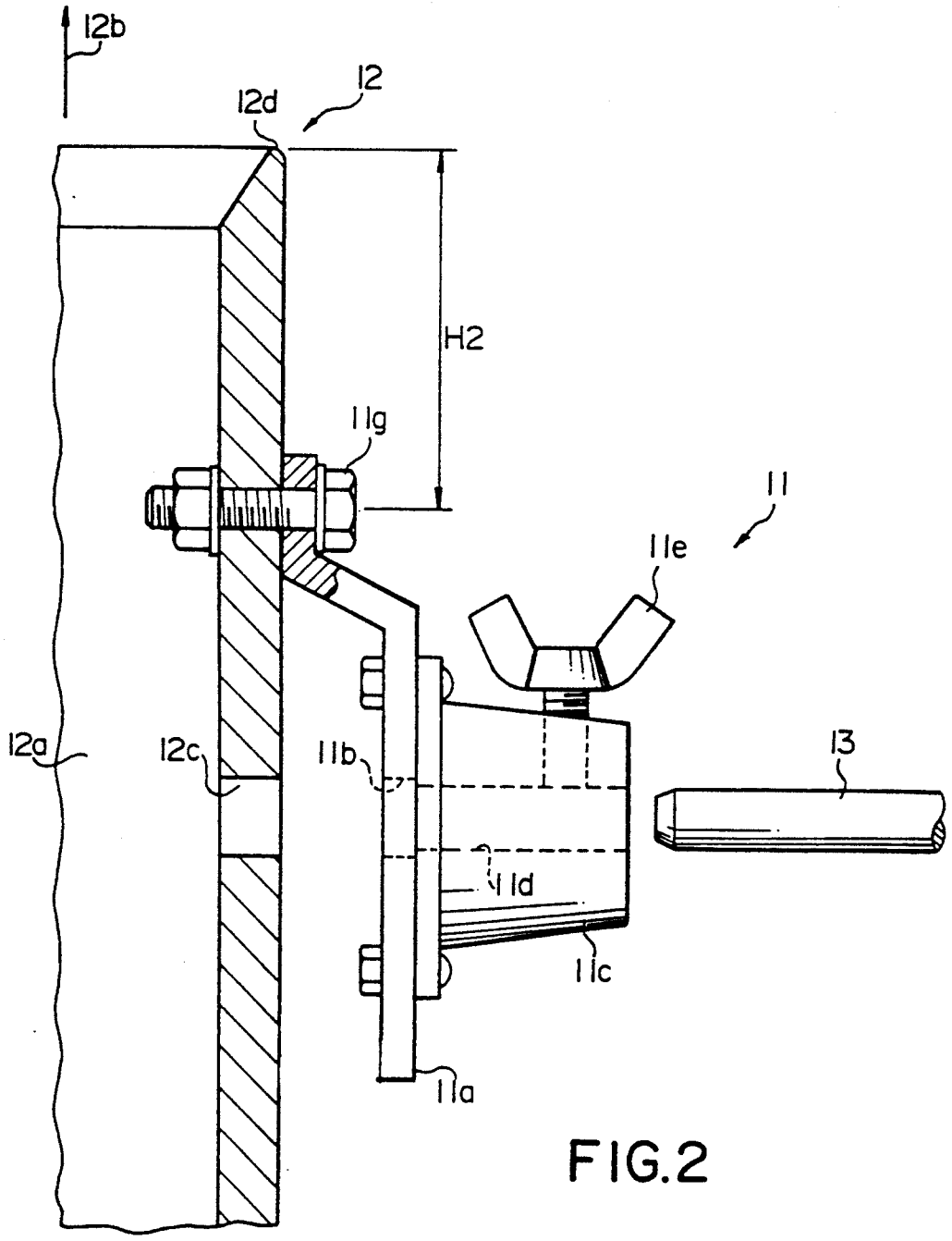
FIG. 2 is a partially cut-away enlarged scale front view showing a supporting mechanism incorporated in a drum according to the present invention.

FIG. 2 of the drawings shows another supporting unit 11 which embodies the present invention. The support unit 11 is affixed to a shell 12 of a drum, and the shell 12 defines a hollow space 12a extending along a predetermined direction 12b. The supporting unit 11 forms a part of a supporting mechanism, and allows a supporting rod 13 of a drum stand to loosely pass through a hole 12c. One of the edges 12d of the shell 12 is tapered, and defines an opening of the hollow space 12a. The tapered edge 12d serves as a standard edge in this instance. Though not shown in FIG. 2, a head is stretched over the opening defined by the tapered edge 12d, and is affixed thereto.

The supporting unit 11 comprises a bracket member 11a having a through hole 11b, a rod clamper or a boss member 11c screwed to the bracket 11a and having a through hole 11d aligned with the through hole 11b. The supporting unit 11 also has a screw bolt 11e projectable into the through hole 11d, and a fastener 11g for coupling the bracket 11a to the shell 12. The fastener 11g is implemented by a bolt and a nut, and the bolt passes through the shell 12 at a predetermined position corresponding to a node of vibrations. In this instance, the node is a point of minimum amplitude of the vibrations and takes place at the area spaced apart from the tapered edge 12d of the shell 12 by a predetermined distance H2. The geometries of the hollow space 12 (i.e., the diameter and the depth) are taken into account so as to determine the distance H2.

In order to support the drum, the rod 13 is inserted through hole 11d, and the screw 11e is moved into the hole 11d so as to be brought into contact with the rod 13. A nylon bushing may be attached to the leading edge of the screw for contact with the rod 13. If the diameter of the drum is small, the rod can proceed into the hollow space 12a through the through holes 11d, 11b and 12c.

When a player beats the head (not shown) with a drum stick, vibrations take place in the head, and the shell 12 propagates the vibrations. The vibrations have a minimum amplitude thereof at the area bolted to the bracket 11a, and thus, the beats are less susceptible to influence from the fastener 11g or the supporting unit 11. Since the rod 13 is insertable into the hollow space 12a, the supporting mechanism 11 is applicable to any sized drum, and accordingly provides greater flexibility for supporting the percussion family.

Third Embodiment

Figure 3:
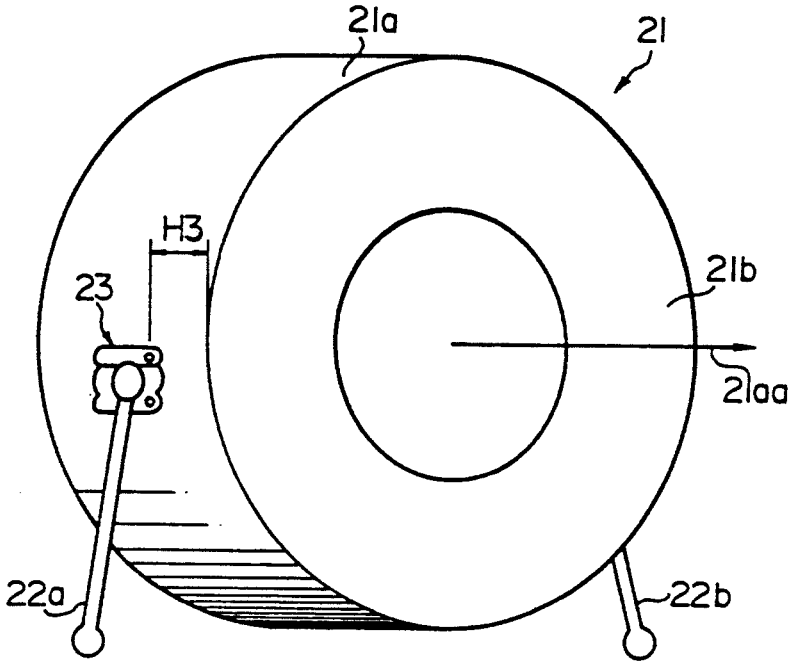
FIG. 3 is a perspective view showing a bass drum according to the present invention.

FIG. 3 of the drawings shows a bass drum 21 comprised of a shell 21a having a hollow space extending along a predetermined direction 21aa substantially aligned with a center axis of the shell. The bass drum 21 also includes a head 21b stretched over an opening at one end of the shell 21a. Legs 22a and 22b support the shell 21a, and a supporting mechanism 23 is implemented by a plurality of supporting units respectively associated with the legs 22a and 22b. In this instance, the legs 22a and 22b serve as a drum stand means. Each of the supporting units is bolted at one end thereof to the shell 21a, and the other end of each supporting unit floats over the surface of the shell 21a. The edge defining the opening covered with the head 21b serves as a standard edge, and the supporting units are affixed to the shell 21a at positions spaced apart from the standard edge by a distance H3. The geometries of the hollow space are taken into account so as to determine the distance H3.

Fourth Embodiment

Figure 4:
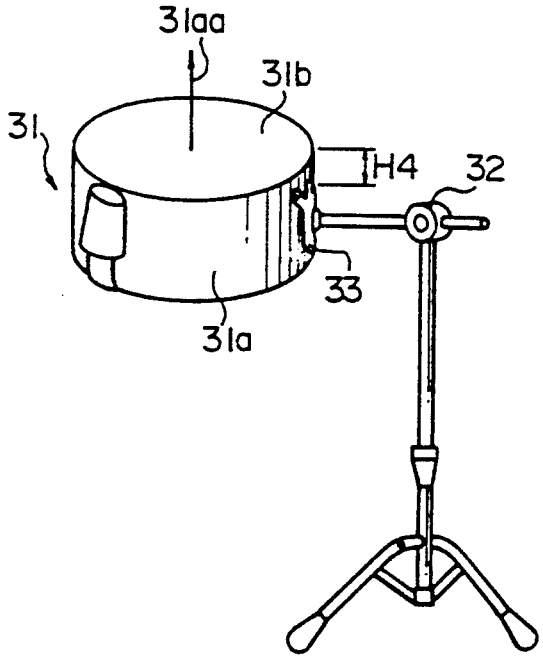
FIG. 4 is a perspective view showing a snare drum according to the present invention.

FIG. 4 of the drawings shows a snare drum 31 which embodies the present invention. The snare drum 31 is supported by a drum stand 32, and comprises a shell 31a having a hollow space extending along a predetermined direction 31aa substantially aligned with a center axis of the shell 31a. The snare drum 31 also includes a head 31b stretched over an opening at one end of the shell 31a, and a supporting mechanism 33. The edge defining the opening covered with the head 31b serves as a standard edge, and the supporting mechanism 33 is affixed at one end thereof to the shell 31a at an area spaced apart from the standard edge by a distance H4. However, the other end of the supporting mechanism 33 floats over the surface of the shell 31a in a cantilever fashion. The geometries of the hollow space are taken into account so as to determine the distance H4.

Fifth Embodiment

Figure 5:
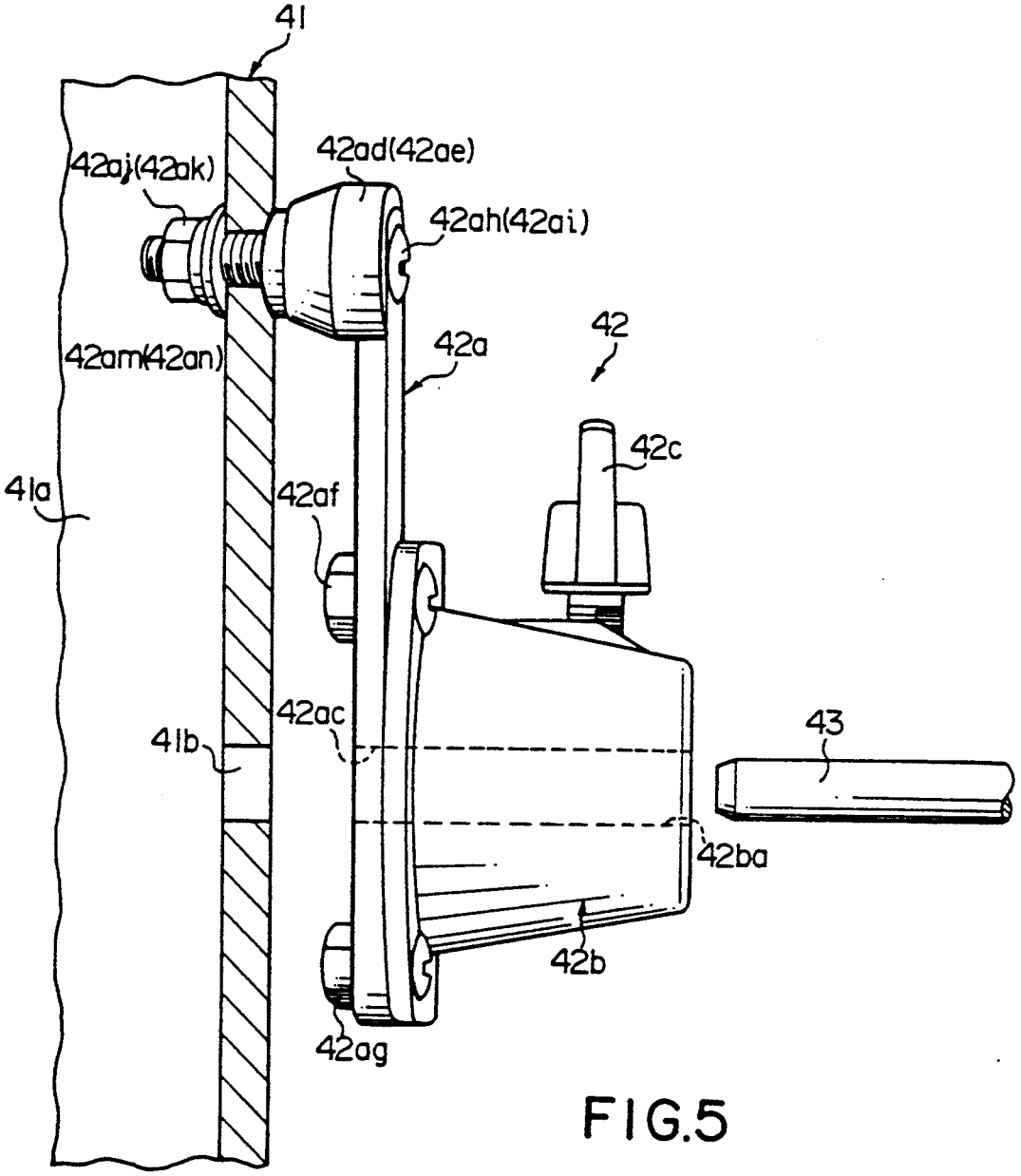
FIG. 5 is a partially cut-away front view showing a supporting mechanism incorporated in a drum according to the present invention.
Figure 6:
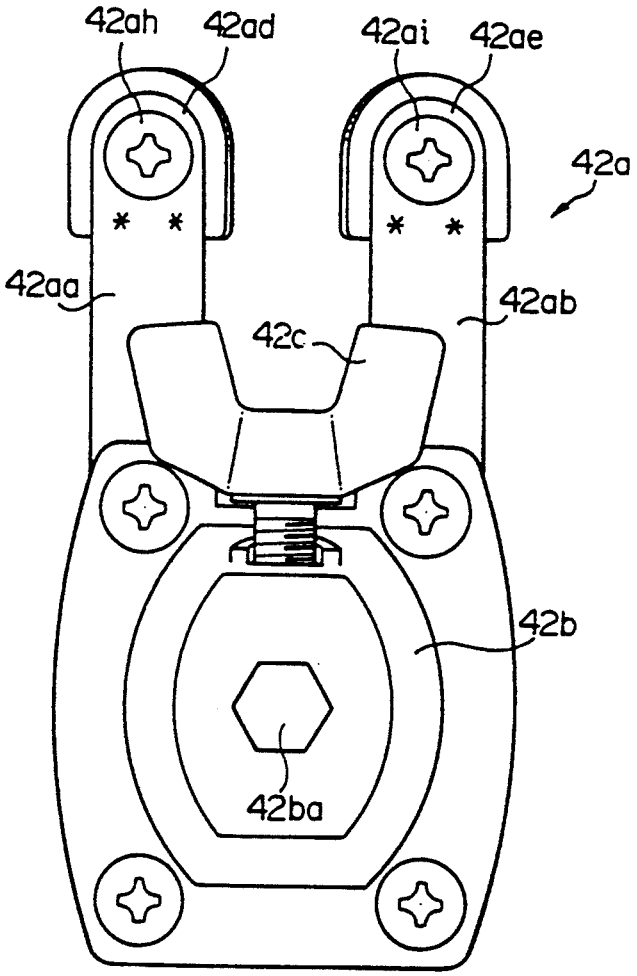
FIG. 6 is a side view showing the supporting mechanism shown in FIG. 5.

FIGS. 5 and 6 of the drawings show a drum which embodies the present invention. The drum comprises a shell 41 having a hollow space 41a and a through hole 41b, and a supporting mechanism 42 coupling a rod 43 of a drum stand means with the shell 41. The supporting mechanism 42 comprises a cantilever 42a, a rod clamper or a boss member 42b bolted to the cantilever 42a, and a screw bolt 42c for affixing the rod 43 to the rod clamper 42b. As will be seen from FIG. 6, the cantilever 42a has a wide portion bolted to the rod clamper 42b, and two arm portions 42aa and 42ab bifurcated from the wide portion of the cantilever 42a. The rod clamper 42b has a through hole 42ba substantially aligned with a through hole 42ac formed in the wide portion as well as with the through hole 41b formed in the shell 41. Therefore, the rod 43 can penetrate into the hollow space 41a, and thus, the supporting mechanism 42 is applicable to any sized drum.

The arm portions 42aa and 42ab have respective arm bases 42ad and 42ae which allow nut members 42af and 42ag to space apart from the shell 41. The arm bases 42 are affixed to the shell 41 by means of bolts 42ah and 42ai which are screwed into nuts 42aj and 42ak. Washers 42am and 42an are inserted between the nuts 42aj and 42ak and the shell 41. The bolts 42ah and 42ai pass through the shell 41 at areas where vibration amplitudes are minimized, and beats are less susceptible to influence from the supporting mechanism 42. Since the supporting mechanism 42 is held in contact with the shell 41 only at the areas which allow the bolts 42ah and 42ai to pass, the beats are further improved in quality.

Sixth Embodiment

Figure 7:
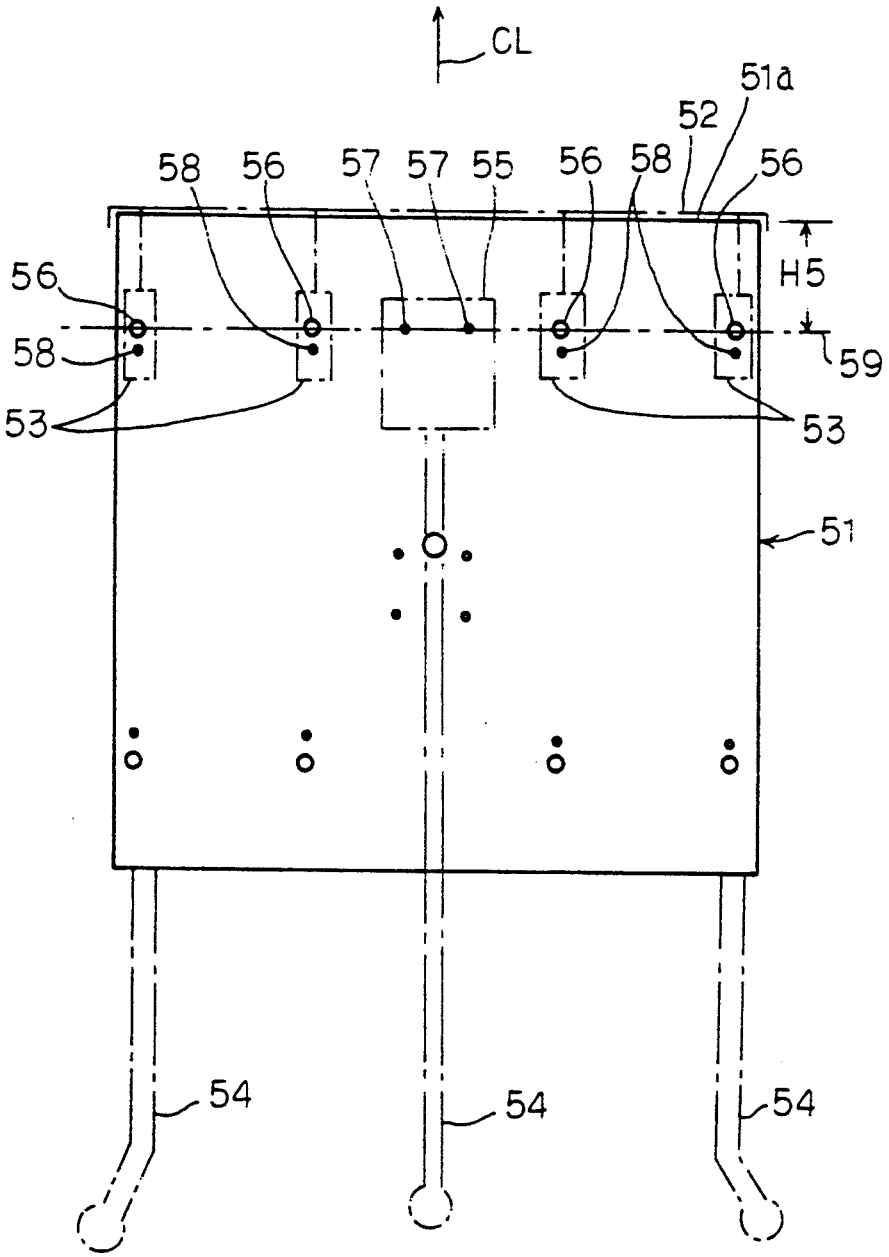
FIG. 7 is a front view showing a shell of a floor-tom according to the present invention.

FIG. 7 of the drawings shows a floor-tom which embodies the present invention. The floor-tom comprises a shell 51 defining an inner hollow space open at both ends thereof, and a center line CL extends along the longitudinal direction of the shell 51. A head 52 is stretched over one of the openings of the shell 51, and is affixed to the shell 51 through a plurality of fastening means 53. Each of the plurality of fastening means 53 may be implemented by a tension rod coupled between a head and a post or lug in a manner similar to the drum described in U.S. Pat. No. 4,660,455, the disclosure of which is incorporated herein by reference. A plurality of supporting units couple the legs 54 to the shell 51, and one of the supporting units is shown and labeled with reference numeral 55. Through holes 56, 57 and 58 are formed in the shell 51, and are arranged on a nodal line 59 spaced apart from an edge 51a of the shell 51 by a predetermined distance H5.

Figure 8:
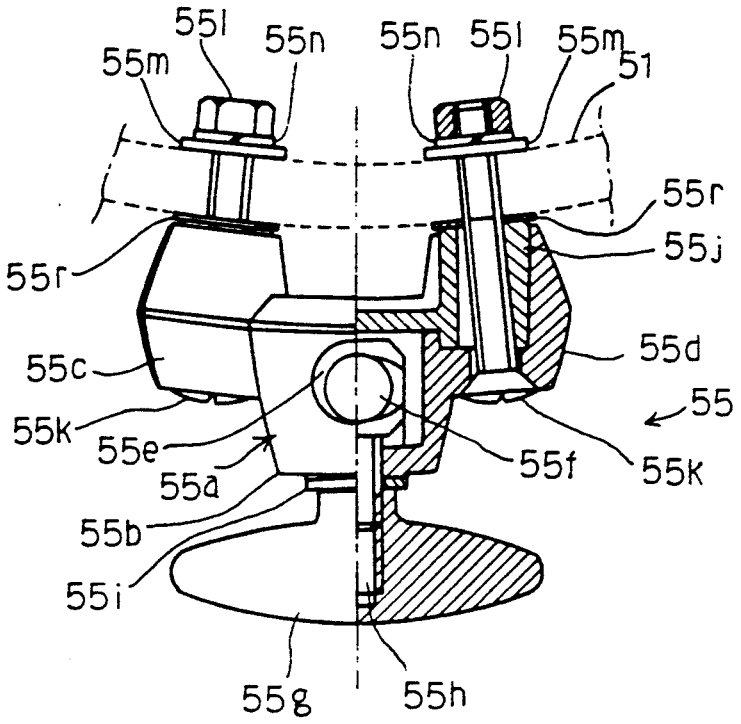
FIG. 8 is a fragmentary cross sectional view showing a supporting unit for the floor-tom according to the present invention.
Figure 9:
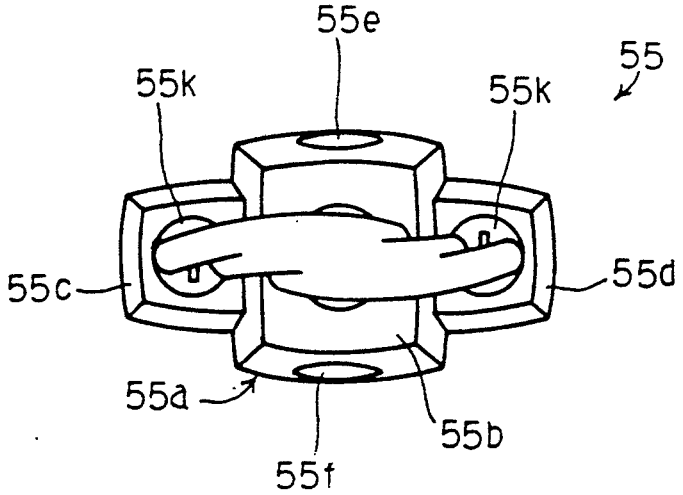
FIG. 9 is a front view showing the supporting unit for the floor-tom according to the present invention.

As will be seen from FIGS. 8 and 9, the supporting unit 55 comprises a bracket 55a, and the bracket 55a has a boss portion 55b and two bulge portions 55c and 55d provided at both sides of the boss portion 55b. A threaded bore 55e is formed in the boss portion 55b, and an eye bolt 55f is threaded so as to interconnect the bracket 55a and the associated leg 54. A wing nut 55g and an associated bolt 55g keep the eye bolt 55f stationary at an arbitrary position in the threaded bore 55e, and a flat washer 55i prevents the wing nut 55g from sticking. Through holes are formed in the bulge portions 55c and 55d, and bracket bases 55j are inserted into the respective through holes and are made of material such as acrylonitrile butadiene styrene. Bolts 55k pass through not only the bracket bosses 55j but also the through holes 57, and project into the inner hollow space of the shell 51. Although the shell 51 is curved, the bracket bosses 55j allow the bolts 55k to be aligned with the radius of the shell 51. Nuts 55l are respectively threaded onto the bolts 55k, and press flat washers 55m and spring washers 55n against the shell 51. Spacers 55r are also pressed flat against the shell 51 and are made of material such as polypropyren.

When a player beats the head 52 of the floor-tom, two kinds of vibrations take place in the shell 51. First, the head 52 per se vibrates, and the vibrations on the head 52 allow the shell 51 to resonate. In other words, the shell 51 indirectly vibrates, and these first vibrations are classified as a resonant oscillation. Second, when the player beats the head 52, force is applied through the head 52 to the shell 51, and the shell 51 per se vibrates under conditions that are constrained by the legs 54. In other words, the shell 51 directly vibrates, and the second vibrations are classified as a forced oscillation.

The fastening means 53 constrain the resonant vibrations to the shell 51. However, the resonant vibrations have a node on the nodal line 59, and thus, the resonant vibrations are less affected by the fastening means 53 which is attached on nodal line 59. For this reason, locating the fastening means 53 on nodal line 59 is desirable to minimize the affect on the resonant vibrations.

The forced vibrations are constrained by the supporting units 55, and the present inventor discovered that the forced vibrations also have a node around the nodal line 59 of the resonant vibrations as described hereinbelow.

Various floor-toms and tom-toms were prepared as specimens. The shells of the specimens ranged between 200 millimeters and 400 millimeters in major diameter and were similarly sized in height. The drum shell thicknesses ranged between 7 millimeters and 10 millimeters. First, a proportion ratio P was calculated from the height H and the major diameter D.

$$P = \frac{H}{D} \tag{1}$$

Subsequently, heads and supporting units were attached to the shells. Further, the locations for affixing the supporting units was able to be changed and the supporting units could be repositioned on the shells. The heads were beaten, and an analyst looked for the appropriate locations where influences on the vibrations were minimized. Table 1 shows the appropriate locations of minimum vibration which were determined for the specimens analyzed. In Table 1, the "H" stands for the height of the drum.

TABLE 1

| Specimen | Type | Proportion | Appropriate Location Xi |
|---|---|---|---|
| 1 | Floor-tom | 1.005 | 0.170H |
| 2 | Tom-tom | 0.858 | 0.172H |
| 3 | Floor-tom | 1.008 | 0.169H |
| 4 | Tom-tom | 0.841 | 0.169H |
| 5 | Tom-tom | 1.010 | 0.167H |
| 6 | Tom-tom | 0.809 | 0.167H |
| 7 | Tom-tom | 0.881 | 0.169H |

The standard deviation of the appropriate locations Xi was then calculated by using Equations 2–5.

$$AV = \left(\sum_{i=1}^{n} Xi\right)/n \tag{2}$$

where AV is the average of the appropriate locations Xi, and n is the number of specimens.

$$\sigma = \sqrt{\sum_{i=1}^{n} (AV - \Sigma i)^2} \quad (3)$$

$$LM = AV - 3\sigma \quad (4)$$

$$UM = AV + 3\sigma \quad (5)$$

where LM and UM stand for the lower limit and the upper limit of the ranges for the appropriate locations Xi.

The lower limit LM and the upper limit UM were 0.15H and 0.19H, respectively, and the appropriate locations preferably ranged between 0.16H and 0.18H.

Thereafter, the present inventor removed the heads from the shells, and the shells were beaten. The analyst looked for the appropriate locations, and calculated the standard deviation for the shells without heads attached. The appropriate locations were in substantially the same locations as shown in Table 1. Thus, the inventor found that the node of resonant vibrations overlapped with the node of forced vibrations.

As will be understood from the foregoing description, it is desirable for the drums to not only have the fastening means 53, but also the supporting units 55 located on a common nodal line of minimized resonant vibrations and forced vibrations.

Seventh Embodiment

Figure 10:
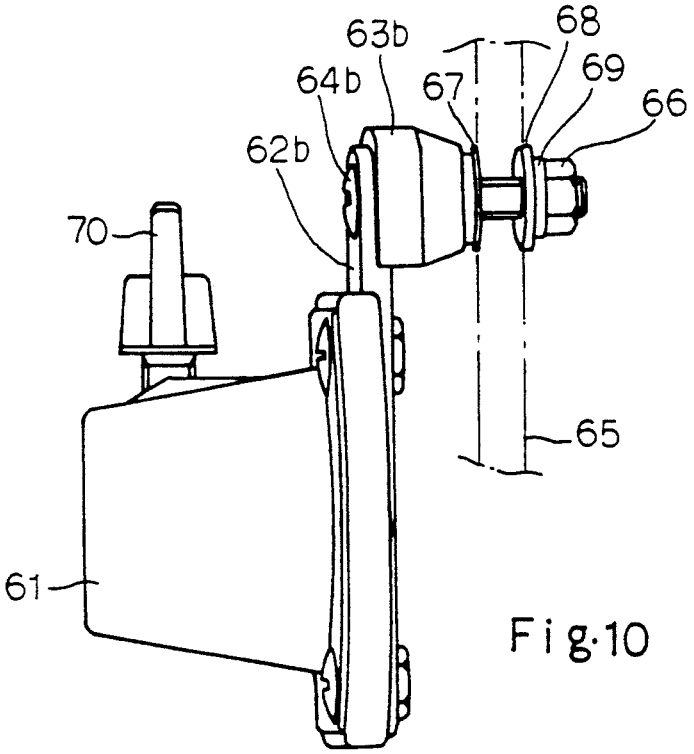
FIG. 10 is a side view showing a supporting unit for a tom-tom according to the present invention.
Figure 11:
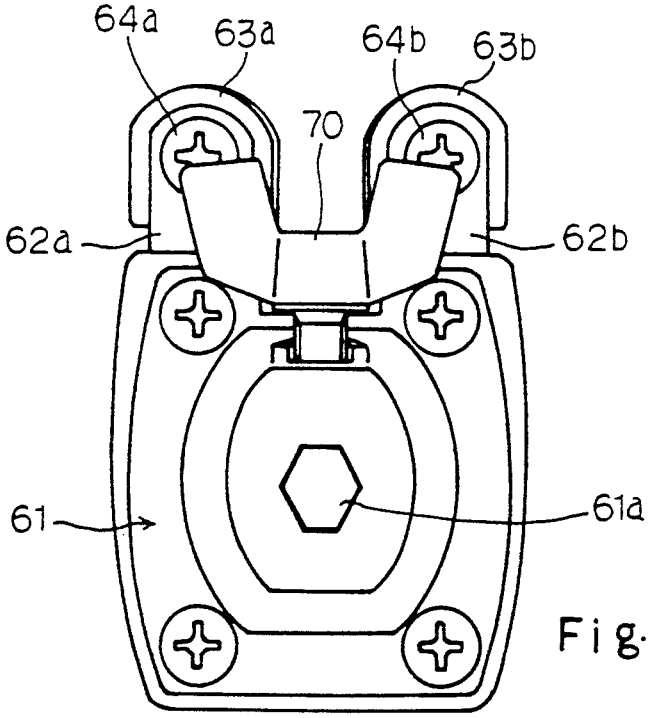
FIG. 11 is a front view showing the supporting unit for the tom-tom according to the prsent invention.

FIGS. 10 and 11 of the drawings shows a supporting unit for a tom-tom which embodies the present invention. The supporting unit comprises a bracket 61 bolted to two arm members 62*a* and 62*b* at the four corners of the bracket 61. Through holes are formed in the arm members 62*a* and 62*b*. Two arm bases 63*a* and 63*b* are provided for the arm members, respectively, and have respective through holes. The through holes of the arm members 62*a* and 62*b* are overlapped with the through holes of the arm bases 63*a* and 63*b*, and two bolts 64*a* and 64*b* respectively pass through the overlapped through holes. The leading ends of the bolts 64*a* and 64*b* pass through a shell 65, and are threaded into nuts 66 inside the shell 65. The shell 65 is sandwiched between spacers 67 made of material such as polypropylene, and flat washers 68 assisted by spring washers 69. The arm bases 63*a* and 63*b* allow the arm members 62*a* and 62*b* to support the bracket 61 in a cantilever fashion.

A hole 61*a* is formed in the bracket 61, and a drum stand (not shown) is inserted into the hole 61*a*. A thumbscrew 70 is threaded into the bracket 61, and presses the drum stand against the inner wall of the bracket member 61 to keep the drum stand at any arbitrary position with respect to the bracket 61. The supporting unit is arranged in such a manner that the distance between the bolts 64*a* and 64*b* and the hole 61*a* is kept as short as possible. For this reason, when the supporting unit is assembled with the shell 65 and the drum stand, the minimum distance prevents the arm members 62*a* and 62*b* from being undesirably deformed. Also, in this way, the arm members 62*a* and 62*b* are not brought into contact with the shell 65.

Eighth Embodiment

Figure 12:
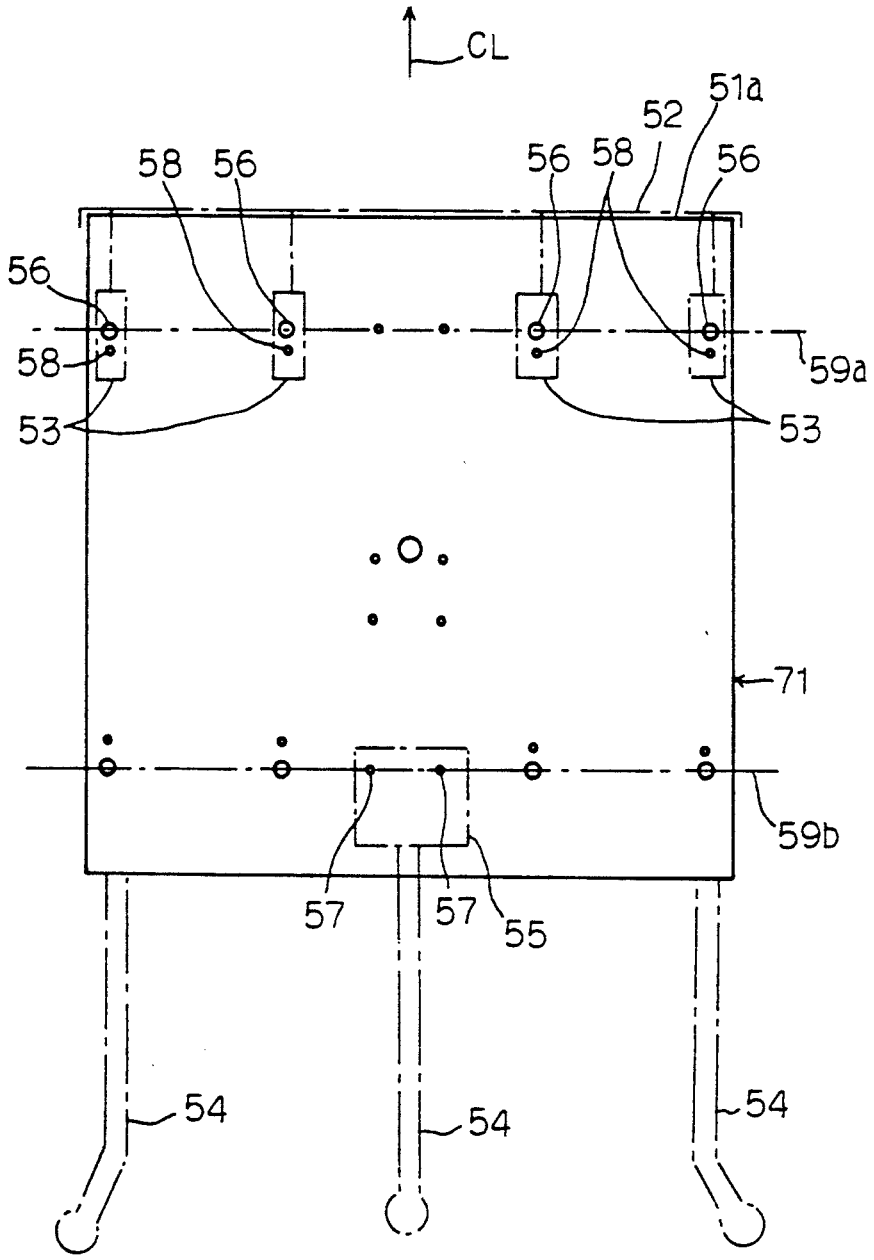
FIG. 12 is a front view showing a shell of another floor-tom according to the present invention.

FIG. 12 of the drawings shows a shell 71 of another floor-tom which embodies the present invention. The shell 71 is similar to the shell 51 except for the locations where the supporting units 55 are attached (see FIG. 7). Therefore, the holes and components of the floor-tom are labeled with the same reference numbers that correspond to the holes and components of the floor-tom implemented in the sixth embodiment, as described above.

The floor-tom shown in FIG. 12 has a plurality of common nodal lines 59*a* and 59*b* representing not only a node of resonant vibrations, but also a node of forced vibrations. The fastening means 53 are affixed to the shell 71 on the nodal line 59*a*, and the supporting units 55 are located on the other nodal line 59*b*. This feature is attractive in view of the mechanical strength of legs 54, and because only a relatively small moment is exerted on the supporting units 55.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A drum comprising:

(a) a shell defining a hollow space;

(b) a head stretched over said hollow space;

(c) a fastening mechanism affixing said head to said shell, for causing resonant vibrations to take place in said shell in the presence of vibrations of said head when said head is beaten, wherein said head transfers a force of a beat to said shell so as to produce forced vibrations in said shell, wherein said resonant vibrations have nodal lines shared with said forced vibrations, and wherein said fastening mechanism is affixed to said shell at a first predetermined location on at least one of said nodal lines; and (d) a supporting mechanism provided between said shell and a drum stand, and affixed to said shell at a second predetermined location on any one of said nodal lines.

2. A drum according to claim 1, wherein said drum serves as one of a bass drum, a floor-tom, a snare drum and a tom-tom.

3. A drum according to claim 1, wherein said supporting mechanism is affixed to said shell in a cantilever fashion.

4. A drum according to claim 1, wherein said any one of said nodal lines to which said supporting mechanism is affixed is the same nodal line as said at least one of said nodal lines to which said fastening mechanism is affixed.

5. A drum according to claim 1, wherein said at least one of said nodal lines to which said fastening mechanism is affixed is a different nodal line from said any one of said nodal lines to which said supporting mechanism is affixed.

6. A method of manufacturing a drum less sensitive to influence from a drum stand, the method comprising the steps of:

forming a shell to define a hollow space;

stretching a head over said hollow space;

fastening said head to said shell at a first predetermined location on at least one of a plurality of nodal lines such that resonant vibrations take place in said shell in the presence of vibrations of said head when said head is beaten, wherein said head transfers a force of a beat to said shell so as to produce forced vibrations in said shell, wherein said resonant vibrations have said nodal lines shared with said forced vibrations; and supporting said shell by a drum stand affixed at a second predetermined location on any one of said nodal lines.

7. A method according to claim 6, wherein said drum is formed to serve as one of a bass drum, a floor-tom, a snare drum and a tom-tom.

8. A method according to claim 6, wherein said drum stand supports said shell in a cantilever fashion.

9. A method according to claim 6, wherein said drum stand supporting said shell is affixed on the same at least one nodal line to which said head is fastened.

10. A method according to claim 6, wherein said drum stand supporting said shell is affixed on a different nodal line than the at least one nodal line to which said head is fastened.

* * * * *